United States Patent [19]

Feinberg

[11] Patent Number: 4,787,101

[45] Date of Patent: Nov. 29, 1988

[54] GARMENT FOR CONVALESCENTS

[76] Inventor: Alixandra Feinberg, 1430 William St., River Forest, Ill. 60305

[21] Appl. No.: 44,803

[22] Filed: Apr. 30, 1987

Related U.S. Application Data

[63] Continuation-in-part of Ser. No. 641,168, Aug. 15, 1984, Pat. No. 4,683,594.

[51] Int. Cl.[4] ..... A41D 1/22

[52] U.S. Cl. ..... 2/105; 2/114

[58] Field of Search ..... 2/69, 74, 76, 105, 114, 2/DIG. 7; 297/465, 464; 128/133, 134

[56] References Cited

U.S. PATENT DOCUMENTS

| | | | |
|---|---|---|---|
| 3,727,238 | 4/1973 | Wolfson | 2/69 |
| 4,026,282 | 5/1977 | Thomas | 128/133 |
| 4,612,673 | 9/1986 | Underhill | 2/DIG. 7 |
| 4,683,594 | 8/1987 | Feinberg | 2/105 |

FOREIGN PATENT DOCUMENTS 484510 5/1938 United Kingdom .

*Primary Examiner*—Henry S. Jaudon

*Attorney, Agent, or Firm*—Neuman, Williams, Anderson & Olson

[57] ABSTRACT

A functional and attractive garment is provided for convalescents who are confined to wheelchairs and secured therein for safety reasons by a restraining device, and those convalescents which have limited walking ability but must use a wheelchair periodically. The garment features slits at either side, through which strap portions of a pelvic or other wheelchair restraint can be drawn from within to outside of the garment for fastening to the back of the wheelchair; a graduated hemline; and color-coded, detachable sleeves. When used in conjunction with such a restraining device, the garment fits the wearer comfortably and falls gracefully over the wearer's knees, preserving warmth and dignity.

16 Claims, 1 Drawing Sheet

GARMENT FOR CONVALESCENTS

This application is a continuation-in-part of U.S. Ser. No. 641,168 filed Aug. 15, 1984 now U.S. Pat. No. 4,683,594.

BACKGROUND OF THE INVENTION

This invention relates to a garment for convalescents who are confined at least part of the time to wheelchairs and who are secured therein for safety reasons by a restraining device. More particularly, this invention relates to a decorative, dignified and highly functional gown which is designed to promote the physical and psychological rehabilitation of convalescents.

In care and rehabilitation institutions, it is common to find invalid and convalescent patients, particularly elderly persons and stroke victims, confined to wheelchairs or having limited walking mobility. Often, such patients lack upper body strength and have difficulty controlling their movements. For example, such patients can slide forward in their wheelchairs, or even turn over their wheelchairs, thereby sustaining injuries. To remedy these problems, various restraining devices have been employed to limit a patient's movement while seated in a wheelchair. A commonly used type of restraining device is a pelvic restraint, which fits underneath a patient's gown and between the legs like a diaper; two sets of straps are used to secure the pelvic restraint by buckling or tying behind the wheelchair.

Additionally, convalescent patients, during the course of their convalescence, may at times have limited walking mobility. In these situations a garment which can easily accommodate different rehabilitation circumstances is needed.

When pelvic restraints such as this are used with women convalescents wearing dresses or hospital gowns, the skirts of their dresses and gowns overlap the restraint straps such that the woman's lower back and thigh regions remain exposed in an undignified manner. Moreover, the skirts do not fall gracefully over her knees and have a tendency to creep upward toward her hips, revealing private parts of the body. When body parts remain exposed, the convalescent is not provided with sufficient warmth and, further, is susceptible to abrasions and skin irritation caused by the rubbing of straps or the wheelchair itself against her skin. Thus, conventional dresses and hospital gowns have been less than satisfactory for use by such women convalescents.

One proposed solution to these problems has been to request that women confined to wheelchairs wear slacks. This solution is unavailable, however, to patients who suffer from increased pain as can be caused by lifting their legs into a pair of slacks. Also, many women find slacks less comfortable than a dress especially when diapers or other medical equipment are placed beneath the dress. Still other, and particularly elderly, women consider it improper or distasteful to wear slacks. These women believe that wearing slacks demeans their femininity, which results in lowered dignity and self-esteem. Furthermore, when used with slacks, the pelvic restraint devices are plainly visible to others, causing the patient to feel more self-conscious and helpless. These negative feelings lead to withdrawal, lack of attention, and inability to concentrate, all of which interfere with the rehabilitation process. A second solution has been to provide lap robes to women convalescents. These lap robes, however, frequently come untied and fall from the patient's lap. Also, these lap robes are of no use to patients with partial mobility when those patients are walking.

These alternatives, while addressing the basic problems, are less than desirable because they fail to provide the self-esteem and femininity accorded a woman by a pretty dress and required for complete rehabilitation.

SUMMARY OF THE INVENTION

It is an object of the invention to provide a decorative, dignified and highly functional clothing garment which is designed to promote the physical and psychological rehabilitation of convalescents. More specifically, it is an object to provide a dress for women convalescents confined at least part of the time to wheelchairs, the dress being specifically designed for maximum utility, safety, comfort and beauty.

It is another object of the invention to provide a convalescent garment which does not look like a hospital gown and which, while attractive in appearance and comfortable to wear, is unconventionally constructed so as to facilitate its use with a variety of fabric restraining devices commonly used to restrain convalescents in wheelchairs.

It is still another object of the invention to provide a convalescent garment which can be used by a patient who has some limited walking mobility, but who may need to be in a wheelchair during certain periods of the day.

It is still another object of the invention to provide a convalescent garment for patients with limited walking mobility who use a cane or walker, have osteoporosis, or have other conditions which cause them to stoop forward while walking or standing.

It is still another object of the invention to provide a convalescent garment which facilitates easy access for medical care and painless dressing, especially for those patients who suffer from upper body deformation caused by osteoporosis and other diseases of the elderly.

It is still another object of the invention to provide a convalescent garment which facilitates the clothing and unclothing of women convalescents with restricted arm and shoulder movements, such as stroke victims.

It is another object of the invention to provide a convalescent garment which does not open in back, thereby providing freedom of movement without fear of embarrassment.

It is still another object of the invention to provide an inexpensive, aesthetic and functional convalescent garment which is not limited in use to a particular stage of rehabilitation.

These and other objects of the invention will be apparent hereinafter from the specification which describes the best mode of practicing the invention as currently known, its fabrication and use, and a preferred embodiment. Reference should also be made to the drawings, which constitute a part of the disclosure, and the subject matter claimed.

Generally, the objects of the present invention are accomplished in a dress having one or more slits at each side of the dress and near the waistline thereof through which strap portions of a pelvic or other wheelchair restraining device can extend from within to outside of the dress for fastening to the back of the wheelchair. This feature of the invention eliminates the unsightly and undesirable circumstance of the woman's dress hanging over the straps, and thereby exposing her lower back and thighs. Additionally, a longer rear hemline on the dress provides sufficient length for those persons who are able to walk, to present themselves with modesty and dignity, and in particular gives the appearance of an even hemline for those patients who must lean forward while walking or standing or who suffer from osteoporosis or other diseases which may cause upper body deformation and a stooped posture. The dress is also sized and shaped to accommodate the changing body shape of elderly women, who tend to be shorter and fuller in the bustline as compared to their regular size. Also, the color-coded, detachable sleeves of the present invention assist both aides and patients themselves in quickly getting the patient dressed or undressed. The individual sleeves can be separated without moving the wearer's arm in order, for example, to allow for quick medical access in emergencies or for routine procedures such as injections and taking the wearer's blood pressure. This aspect of the invention is particularly important in light of the fact that many patients develop frozen shoulders, making movement of the arms painful. Eliminating unnecessary pain helps to prevent deterioration of the convalescent's attitude which is important for successful rehabilitation.

While the invention disclosed herein has been described primarily with reference to a woman's dress, it is to be understood that it is within the scope of the invention to also provide a convalescent gown for men which incorporates the same novel features.

BRIEF DESCRIPTION OF THE DRAWINGS

For a more complete understanding of this invention, reference should be made to the drawings, as briefly described below.

DESCRIPTION OF THE PREFERRED EMBODIMENT

Figure 1:
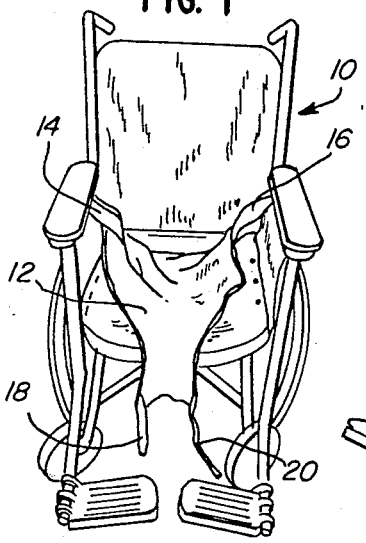
FIG. 1 is a front view of a wheelchair with a conventional, fabric pelvic restraint partially strapped thereto.

Referring now to FIG. 1, a typical wheelchair 10 is illustrated, with a conventional pelvic restraint 12 partially secured thereto by straps 14 and 16. The illustrated pelvic restraint 12 is of the fabric type sold by the J. T. Posey Company of Arcadia, Calif. In use, the unfastened straps 18 and 20 are drawn upward between the convalescent's legs and tied around the convalescent's waist to the back of the wheelchair. The convalescent's gown, dress or other garment is worn over the restraint 12. Thus, if soiled, the pelvic restraint 12 can be replaced without changing the convalescent's clothing.

For this and other reasons, a separate restraining device and clothing article are preferred to a patient restraining gown of the type disclosed in U.S. Pat. No. 4,026,282 to Thomas. Gowns with attached restraining belts fail to secure the buttocks and pelvic areas where the possibility of slippage from the wheelchair is greatest. The gown can easily rip away from the securing belts. The present invention provides a comfortable and aesthetic convalescent dress without sacrificing the protection and security accorded by conventional restraint devices.

The pelvic restraint is the most common wheelchair restraining device, although it is also known to use other fabric restraints for specific applications; e.g. chest restraints are used where additional upper body support is required. It will be appreciated that the garment of the present invention can accommodate a number of different types of restraining devices.

Figure 2:
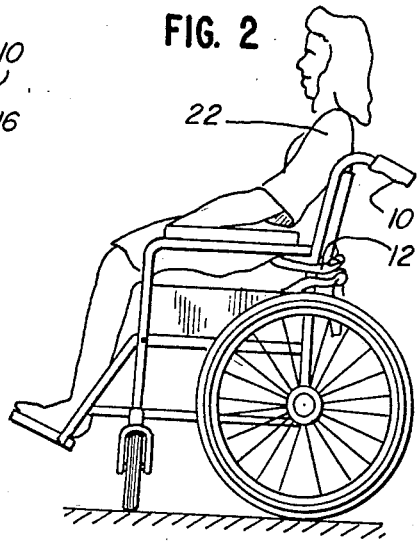
FIG. 2 is a side view of a woman convalescent seated in a wheelchair and wearing a conventional dress.

Referring now to FIG. 2, and using like numbers to designate like items to assist in understanding the several views, a woman in a wheelchair, shown wearing a conventional dress 22, is secured to a wheelchair 10 by the pelvic restraining device 12 of FIG. 1. Additionally, it has been observed that the front skirt of dresses so worn have a tendency to creep up over the woman's knees, as can be seen in FIG. 2. Combined with the bunched up back, the creeping front skirt tends to expose portions of the woman's buttocks, thighs and private regions. This phenomenon frequently necessitates the use of unsightly lap robes to provide additional coverage and warmth for the patient when seated in a wheelchair. These lap robes are unsatisfactory because the ties can become undone and the lap robe can become caught in the wheels of the wheelchair.

Figure 3:
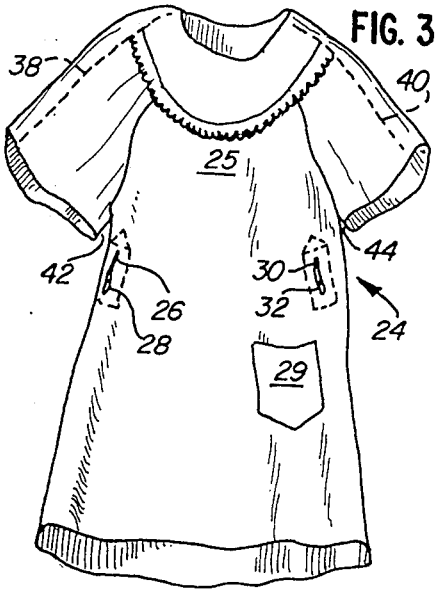
FIG. 3 is a front elevation view of a convalescent garment fabricated according to the present invention.
Figure 4:
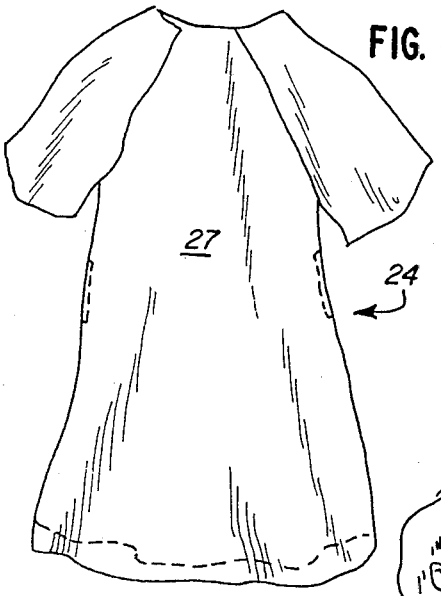
FIG. 4 is a rear elevation view of a convalescent garment fabricated according to the present invention.
Figure 5:
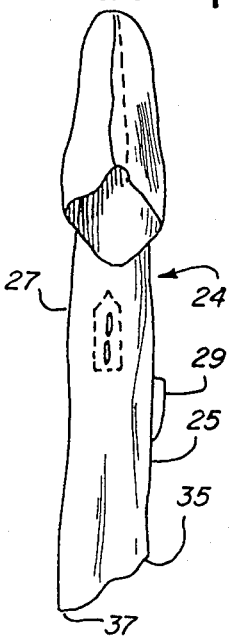
FIG. 5 is a side elevation view of a convalescent garment fabricated according to the present invention.

In keeping with the aforestated objectives, and to avoid the demeaning circumstance illustrated in FIG. 2 and previously described herein, a dress 24 is provided as illustrated in FIGS. 3–5. The dress includes a front portion 25 and a back portion 27. Front portion 25 may be provided with one or more pockets 29. In the preferred embodiment, dress 24 is characterized by a first pair of openings or slits 26 and 28 on one side of the dress, and a second pair of openings or slits 30 and 32 on the other side of the dress. Dress 24 includes a right sleeve detachable along line 38 and a left sleeve detachable along line 40.

Dress 24 is further characterized by a graduated hemline. As shown in the FIGS., front portion 25 has a modest front hemline 35 which gracefully covers the wearer's knees when she is seated in her wheelchair. Back portion 27 has a longer rear hemline 37 which ensures that the back of the wearer's legs will be modestly covered when she rises from her wheelchair. Longer rear hemline 37 also provides the appearance of an even hemline for the total garment when the wearer is standing or walking especially for those patients who stoop or lean forward when standing, or who suffer from osteoporosis or other diseases which can cause upper body deformities. Rear hemline 37 may be $2\frac{1}{2}''$–$3\frac{1}{2}''$ longer than front hemline 27.

As a further advantage, the overall length of the garment is designed to accommodate the changing body shape of elderly women. Research has shown that elderly women tend to be shorter and fuller in the bustline than their regular size. Thus the standard "small," "medium " and "large" sizes of regular women's clothing are too long for elderly women and at the same time do not provide the necessary fullness in the bustline area. Thus, in addition to the graduated hemline, the overall length of the dress is shorter, and the dress is provided with adequate fullness in the bustline area, to accommodate the special needs of the elderly women. The dress is also provided with adequate fullness in the back area for those patients who suffer from osteoporosis or other upper body deformities.

It will be appreciated that the location and number of slits in dress 24 can vary depending on the restraining device with which the dress is to be used. The four slits 26, 28, 30 and 32 of FIG. 3 are intended to receive the four straps 18, 14, 20 and 16, respectively, of the pelvic restraint 12 of FIG. 1. For this application, it has been determined that the slits 26 and 30 should be approximately 6½ inches from the underarm seams 42 and 44, respectively. Each longitudinal slit opening, in the preferred embodiment, is 1½" long with ½" length between the two slits. It will be appreciated that the size of the slits may be varied in accordance with the type of restraining device used. If necessary, the fabric portions between slits pairs 26, 28 and 30, 32 can be eliminated to provide a single longer slit on each side.

Figure 6:
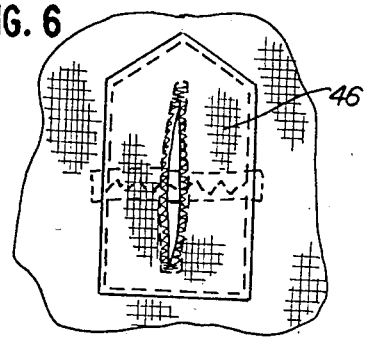
FIG. 6 is an enlarged view of an embodiment of the side slits of the present invention, as seen from the inside of the dress, showing reinforcing webbing affixed thereto.

Due to the increased stress points caused by the slits, it is desirable to reinforce the slits with a strong binding material, as shown in FIGS. 6. The binding material 46 can be any strong material suitable for the purpose of strengthening the dress regions adjacent to the slits, including without limitation sailcloth or heavy cotton webbing. A tight zig-zag stitch has been found to satisfactorily affix the binding material 46 to the inside of dress 24, and thereafter reinforce the slits themselves. Other stitches, as well as adhesives, perform a similar function.

Figure 7:
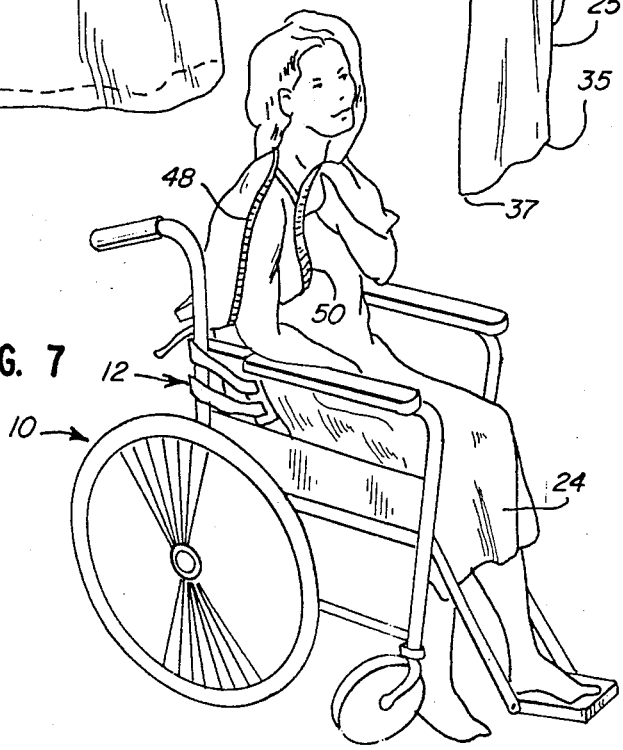
FIG. 7 is a perspective view of a woman convalescent seated in a wheelchair and wearing a convalescent garment fabricated according to the present invention.
Figure 8:
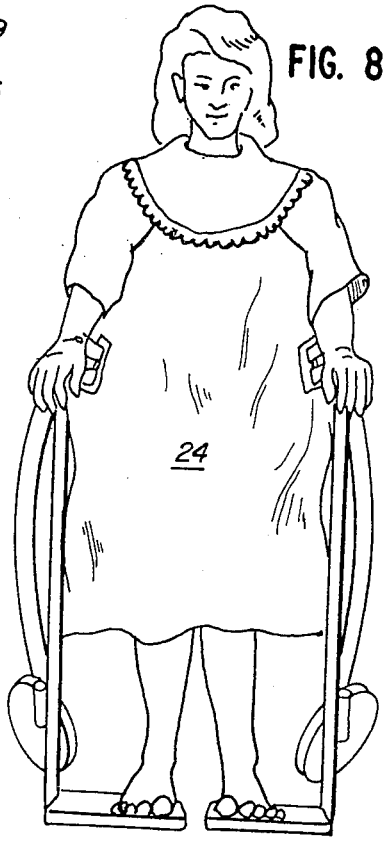
FIG. 8 is a front view of a woman convalescent seated in a wheelchair and wearing a convalescent garment fabricated according to the present invention.

Referring now to FIGS. 7 and 8, a woman seated in a wheelchair, shown wearing dress 24, is secured to a wheelchair 10 by the pelvic restraining device 12 of FIG. 1. In sharp contrast to the use of a conventional dress 22, as shown in FIG. 2, the woman in FIGS. 7 and 8 is seen to be comfortably seated with dignity in wheelchair 10. Dress 24 falls gracefully over her knees and all body parts are covered without necessity of a lap robe. The dress also provides warmth to the joints.

Referring more specifically to FIG. 7, the aforementioned right detachable sleeve is shown separated from the neck down. There exist a number of suitable means to refasten the sleeve, such as a pair of cooperating self-adhering fabric strip members 48 and 50, such strip members being affixed to the detached portions of the sleeve. Alternative fastening means such as snaps or zippers can offer the advantages of greater comfort to the wearer and greater durability. The left sleeve of dress 24, not fully shown in FIG. 7, is constructed in the same detachable manner.

To avoid having a loose dress that might otherwise appear to be an awkward shape of material, it has been found advantageous to color-code either the fastening members on each sleeve or the sleeves themselves. This color-coding assists the wearer or her aides in efficiently orienting and donning the dress. Color coding also aids those patients who are disoriented and must learn right from left in order to carry out the activities of daily living. Consistent with industry convention, the color red has been selected to designate the right side of the dress.

The described detachable sleeves can be opened to facilitate nursing care, as well as the dressing or undressing, of the patient with minimal arm and shoulder movement. Thus, injections, blood pressure testing, EKGs and so on are readily performed without removal of the entire dress and without the wearer having to extricate her arm from the sleeve, frequently a painful maneuver for patients suffering from a frozen shoulder or other similar physical limitation.

For practical purposes, the garment should be durable. Thus all stress seams are preferably double-stitched. Similarly, it is preferable to use a material which is wrinkle-free, breathable and colorfast. A material which transports perspiration is important because infirm and aged persons must avoid skin breakdown from moisture. A colorfast material insures that the dress will retain its beauty, thus performing its psychological rehabilitative function. Also, since one anticipates frequent laundering of clothing articles used in this application, and because many infirm and aged persons are on a limited budget, durability is another important factor in selecting a suitable fabric. Fabrics found particularly suitable for use in this invention include Visa fabric, manufactured by Milliken and Company in New York, and Comfort Fiber TM made by Burlington, Inc.

From the description thus far provided, it is apparent that the proposed dress may be used with a variety of restraining devices and that a number of modifications can be made in the invention disclosed, by those having the benefit of the foregoing teachings, without departing from the spirit and scope of these principles. Accordingly, while the invention disclosed herein has been described with reference to an illustrated embodiment of the presently contemplated best mode for practicing the invention, it is intended that this 20 invention be limited only by the scope of the appended claims.

What is claimed is:

1. A dress-like garment suitable for dignified wear in public for use by a convalescent wearer confined at least part of the time to a wheelchair and secured therein for safety reasons by a restraining device distinct from the dress-like garment said restraining device having strap portions which are intended to be fastened to such wheelchair, said dress-like garment comprising a body portion, said body portion including a front portion having a front hemline and a back portion having a rear hemline which is longer than said front hemline, a sleeve portion, and opening means within the body of said garment through which such strap portions of such restraining device can extend from within to outside of said garment for fastening such restraining device to such wheelchair, said garment substantially concealing the restraining device while covering the wearer so as to be suitable for dignified wear in public.

2. A garment as defined in claim 1, wherein said rear hemline is about 2½ to 3½ inches longer than said front hemline.

3. A garment as defined in claim 1, wherein said front portion covers the wearer's knees when the wearer is seated in such wheelchair.

4. A garment as defined in claim 1, wherein said opening means comprises at least one slit near each side of said garment through which strap portions of such restraining device can extend from within to outside of said garment for fastening such restraining device to such wheelchair.

5. A garment as defined in claim 4, wherein said slits are reinforced to avoid fraying of said garment.

6. A garment as defined in claim 1, wherein said opening means comprises a pair of longitudinal slits located at each side of said garment near the waistline thereof.

7. A garment as defined in claim 1, wherein said sleeve portions are detachable to facilitate the donning thereof and to permit the giving of injections and taking of the wearer's blood pressure with minimal movement of the wearer's arms.

8. A garment as defined in claim 7, wherein said detachable sleeve portions are color-coded to distinguish right from left.

9. A garment as defined in claim 8, wherein the detached portions of said sleeves are secured by cooperating releasable fastening means.

10. A decorative and dignified dress for use by a convalescent female wearer confined at least part of the time to a wheelchair and secured therein for safety reasons by a restraining device which is intended to be fastened to such wheelchair, comprising:

a front portion extending downwardly to a lower edge defining a front hemline, said front portion covering the wearer's knees when the wearer is seated in such wheelchair;

a rear portion extending downwardly to a lower edge defining a rear hemline, said rear hemline being longer than said front hemline; and longitudinal, reinforced slits located at each side of said dress near the waistline thereof through which strap portions of such restraining device can extend from within to outside of said dress for fastening such restraining device to, and securing such wearer in, such wheelchair.

11. A dress-like garment for use by a convalescent wearer confined to a wheelchair and secured therein for safety reasons by a restraining device having strap portions which are intended to be fastened to such wheelchair, comprising:

a front portion extending downwardly to a lower edge defining a front hemline, said front skirt portion covering the wearer's knees;

opening means within the body of said garment through which such strap portions can extend from within to outside of said garment for fastening such restraining device to such wheelchair;

a rear portion extending from the dress waistline downwardly to a substantially straight lower edge defining a rear hemline, said rear hemline being longer than said front hemline.

12. The garment of claim 11 wherein said opening means comprises longitudinal slits located on each side of said garment.

13. The garment of claim 12 wherein said slits are about 1½ inches long and about ½ inch wide.

14. The garment of claim 11 having a back portion which provides adequate fullness for patients who have osteoporosis or other upper body deformities.

15. The garment of claim 11 having a front portion which provides adequate fullness for patients with full bustlines.

16. The garment of claim 11 wherein the overall length thereof is shorter than standard to accommodate elderly patients.

* * * * *